US006786660B1

(12) United States Patent
Woosley et al.

(10) Patent No.: US 6,786,660 B1
(45) Date of Patent: Sep. 7, 2004

(54) DETECTABLE SPOOL AND ASSOCIATED HUB

(75) Inventors: Ernie L. Woosley, Greensburg, PA (US); Doug Jackson, Alison, PA (US); Kiichi Sugasawa, Tokyo (JP); Katsuhisa Orihara, Tokyo (JP); John A. Pomfret, East Lyme, CT (US)

(73) Assignee: Sony Chemicals Corporation of America, Mount Pleasant, PA (US)

( * ) Notice: Subject to any disclaimer, the term of this patent is extended or adjusted under 35 U.S.C. 154(b) by 44 days.

(21) Appl. No.: 10/078,639

(22) Filed: Feb. 19, 2002

(51) Int. Cl.[7] ..... B65H 75/00

(52) U.S. Cl. ..... 400/244; 400/242; 400/249; 400/219.4; 242/338; 242/357; 242/912

(58) Field of Search ..... 400/219.3, 219.4, 400/244, 249, 242, 243; 242/338, 357, 363, 362.3, 912

(56) References Cited

U.S. PATENT DOCUMENTS 4,111,378 A * 9/1978 Barwick ..... 242/563.2
4,993,659 A * 2/1991 Takai et al. ..... 242/333.6
5,153,625 A * 10/1992 Weber ..... 396/284
5,234,175 A 8/1993 Pagano
5,326,182 A * 7/1994 Hagstrom ..... 400/223
5,385,416 A 1/1995 Maekawa et al.
5,393,149 A 2/1995 Iima
5,755,519 A 5/1998 Klinefelter
5,808,284 A * 9/1998 Domanik ..... 235/462.01
5,875,983 A 3/1999 Stuckey et al.
6,152,625 A 11/2000 Oliverio
6,199,786 B1 * 3/2001 Lessard et al. ..... 242/406
6,263,170 B1 7/2001 Bortnem

* cited by examiner

*Primary Examiner*—Andrew H. Hirshfeld
*Assistant Examiner*—Dave A. Ghatt
(74) *Attorney, Agent, or Firm*—Brij K. Agarwal; Eckert Seamans Cherin & Mellott, LLC

(57) ABSTRACT

An improved detectable spool for use with a ribbon includes an improved hub which includes a core and an indication member. The indication member is a generally planar metallic member that is substantially embedded in the core, with the indication member including a support and a plurality of tabs. In at least one embodiment the indication member is a monolithically formed single-piece member, while in another embodiment the indication member is a multi-component member.

73 Claims, 7 Drawing Sheets

DETECTABLE SPOOL AND ASSOCIATED HUB

BACKGROUND OF THE INVENTION

1. Field of the Invention

The present invention relates generally to printer ribbons and, more particularly, to a detectable spool including indicia that indicate properties of a length of ribbon wound on the detectable spool.

2. Description of the Related Art

Thermal transfer printing equipment is generally known in the relevant art. One type of known thermal transfer process involves the application with a thermal print head of an elevated temperature to regions of a thermal transfer ribbon, with resultant melting of an ink compound of the ribbon at the aforementioned regions. The molten ink compound becomes transferred onto a substrate, which thereby imprints the ink compound onto the substrate. Each ribbon typically is divided into a plurality of consecutively positioned panels, with each panel being usable only for a single printing operation.

Depending upon the type of printing being performed, it may be desirable to have different types of panels provided on the same ribbon. For instance, when it is desired to perform color printing, a given ribbon may consecutively include separate panels containing ink compounds that are colored yellow, magenta, and cyan. A color image that is desired to be printed onto a substrate may be broken up into component images of yellow, magenta, and cyan light. A single color printing operation thus may include three consecutive printing operations, one involving yellow ink, one involving magenta ink, and one involving cyan ink. An appropriately configured color thermal transfer ribbon thus might include consecutive yellow, magenta, and cyan panels repetitively from the beginning of the ribbon to the end of the ribbon. Such a ribbon might bear a designation such as YMC to designate the yellow/magenta/cyan repetitive pattern.

It may additionally be desirable for each series of color panels on the ribbon to be followed by a black panel if it is desired that black printing be provided along with color printing. Such a black panel may be designated by the letter K in the ribbon designation. It may further be desirable to provide an overlay panel on the ribbon which can be used to apply a scratch-resistant overlay surface to the substrate after color and/or black imprintation has occurred. Such an overlay panel may be designated by the letter O in the ribbon designation. It can be seen, therefore, that a thermal transfer ribbon having repetitive series of yellow, magenta, cyan, black, and overlay panels would bear the designation YMCKO. It similarly can be seen that a thermal transfer ribbon having repetitive panels solely of black ink would bear the designation K.

It thus can be seen that numerous different ribbon configurations are possible. It can further be seen that the large number of different ribbon configurations can potentially cause a ribbon having a given panel configuration to be confused by a technician or operator with another ribbon having a different panel configuration. It has thus been deemed desirable to provide some type of indicia on a ribbon spool that will identify to a printer the specific panel configuration of the ribbon wound on the spool. Such a system is the subject of U.S. Pat. No. 5,755,519 to Klinefelter and U.S. Pat. No. 6,152,625 to Oliverio. It is desired, however, to provide an improved detectable spool with identifier indicia that are more reliable, both structurally and operationally, and that can be manufactured less expensively than previously known detectable spools. It is also desired to provide such an improved detectable spool that additionally includes identifier indicia that can visually indicate to an observer the specific panel arrangement of a ribbon.

SUMMARY OF THE INVENTION

Accordingly, an improved detectable spool for use with a ribbon includes an improved hub which includes a core and an indication member. The indication member is a generally planar metallic member that is substantially embedded in the core, with the indication member including a support and a plurality of tabs. In at least one embodiment the indication member is a monolithically formed single-piece member, while in another embodiment the indication member is a multi-component member.

An aspect of the present invention is to provide an improved hub that includes identifier indicia that indicate to a printer the properties of a ribbon wound on a spool.

Another aspect of the present invention is to provide an improved hub that includes identifier indicia and that is relatively less expensive to manufacture than previously known hubs.

Another aspect of the present invention is to provide an improved hub including identifier indicia that are relatively more reliable in function than previously known hubs.

Another aspect of the present invention is to provide an improved hub including identifier indicia that are relatively easy to manufacture.

Another aspect of the present invention is to provide an improved hub including identifier indicia that not only can be detected by a printer but that can also be visually identified by an observer.

Another aspect of the present invention is to provide an improved detectable spool incorporating an improved hub of the type indicated above.

Another aspect of the present invention is to provide an improved indication member that can serve as identifier indicia for a hub of a detectable spool that identifies characteristics of a length of ribbon wound on the detectable spool.

These and other aspects of the present invention are achieved by a hub for use in conjunction with a spool, in which the general nature of the hub can be stated as including a core including a central axis, the core being structured to be disposed on the spool, and an indication member, the indication member including a support and at least a first tab, the support being mounted on the core, the at least first tab being disposed on the support, and the at least first tab including an elongated dimension that extends in a generally radial direction with respect to the central axis of the core.

Another aspect of the present invention is to provide a hub for use in conjunction with a spool, in which the general nature of the hub can be stated as including a core structured to be disposed on the spool, and an indication member, the indication member including a support and at least a first tab, the support being mounted on the core, the at least first tab being disposed on the support, and the support and the at least first tab each being of a generally planar configuration.

Another aspect of the present invention is to provide a detectable spool for use in a printer, in which the general nature of the detectable spool can be stated as including a spool including a central axis, and indication means disposed on the spool, the indication means including an indication member, the indication member including a support and at least a first tab, and the at least first tab including an elongated dimension that extends in a generally radial direction with respect to the central axis.

Another aspect of the present invention is to provide a detectable spool for use in a printer, in which the general nature of the detectable spool can be stated as including a spool, and indication means disposed on the spool, the indication means including an indication member, the indication member including a support and at least a first tab, and the support and the at least first tab each being of a generally planar configuration.

Another aspect of the present invention is to provide a hub for use in conjunction with a spool, in which the general nature of the hub can be stated as including a core including a central axis, the core being structured to be disposed on the spool, and an indication member, the indication member including a support and a plurality of tabs, the support being mounted on the core, the tabs being disposed on the support, and the support extending between the tabs.

Another aspect of the present invention is to provide a indication member for incorporation into a detectable spool for use in a printer, the printer including a sensing apparatus, in which the general nature of the indication member can be stated as including a support and a plurality of tabs, the support extending between the tabs, the tabs protruding from the support, and the tabs being structured to be detectable by the sensing apparatus.

BRIEF DESCRIPTION OF THE DRAWINGS

A further understanding of the invention can be gained from the following Description of the Preferred Embodiments when read in conjunction with the accompanying drawings in which.

Similar numerals refer to similar parts throughout the specification.

DESCRIPTION OF THE PREFERRED EMBODIMENTS

Figure 1:
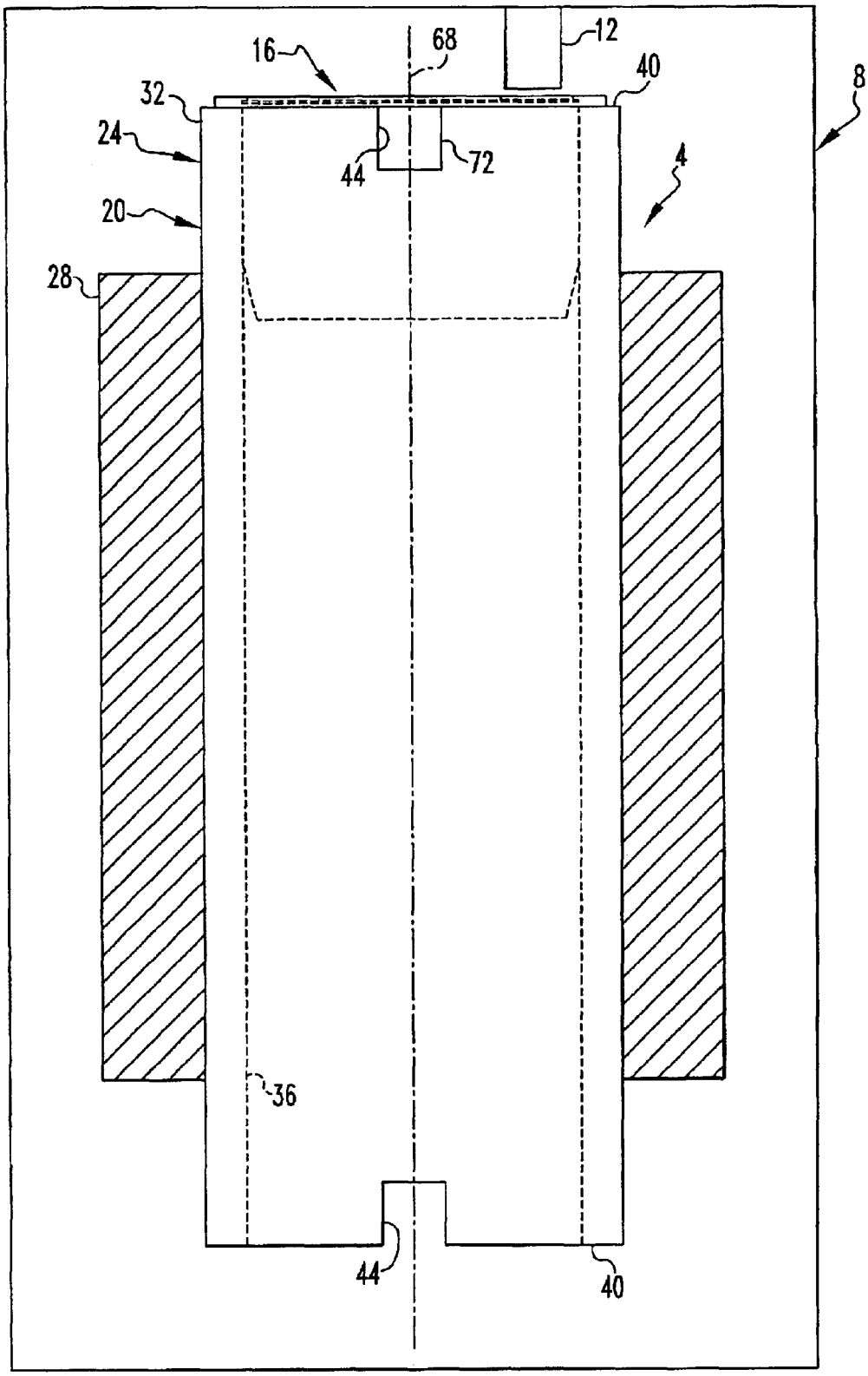
FIG. 1 is an elevational view of a detectable spool in accordance with the present invention disposed within a schematically depicted printer.

A detectable spool 4 in accordance with the present invention is indicated as being disposed within a schematically depicted printer 8 in FIG. 1. The detectable spool 4 is specifically configured to include indicia that indicate to the printer 8 various characteristics of the detectable spool 4. The printer 8 includes a schematically-depicted sensor 12, which is part of a sensing apparatus that is configured to detect the indicia included in the detectable spool 4.

As can be understood from FIG. 1, the detectable spool 4 includes a hub 16 in accordance with a first embodiment of the present invention and a ribbon spool 20. The ribbon spool 20 can be generally stated as including a generally hollow cylindrical spool 24 with a length of ribbon 28 being wound on an outer surface 32 of the spool 24. As will be set forth more fully below, the ribbon 28 can be of numerous configurations and may be a dye diffusion thermal transfer ribbon or other type of ribbon. As will be described in greater detail below, the indicia of the detectable spool 4 advantageously can communicate to either or both an observer and the sensor 12 of the printer 8 various characteristics of the ribbon 28.

The spool 24 is formed with a substantially cylindrical thru-bore 36 extending coaxially throughout the longitudinal extent of the spool 24. The spool 24 terminates at a pair of annular ends 40, with each end 40 being formed with a pair of diametrically opposed notches 44. As will be explained in greater detail below, the notches 44 assist in resisting relative rotation between the hub 16 and the spool 24.

Figure 2:
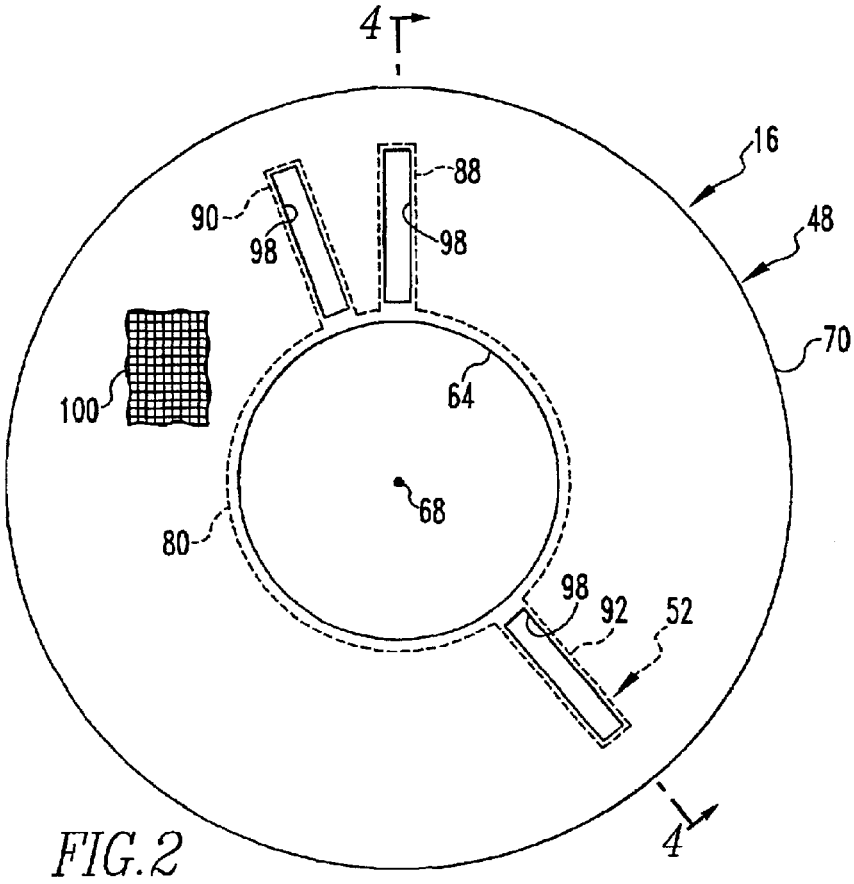
FIG. 2 is a plan view of an improved hub in accordance with a first embodiment of the present invention.
Figure 3:
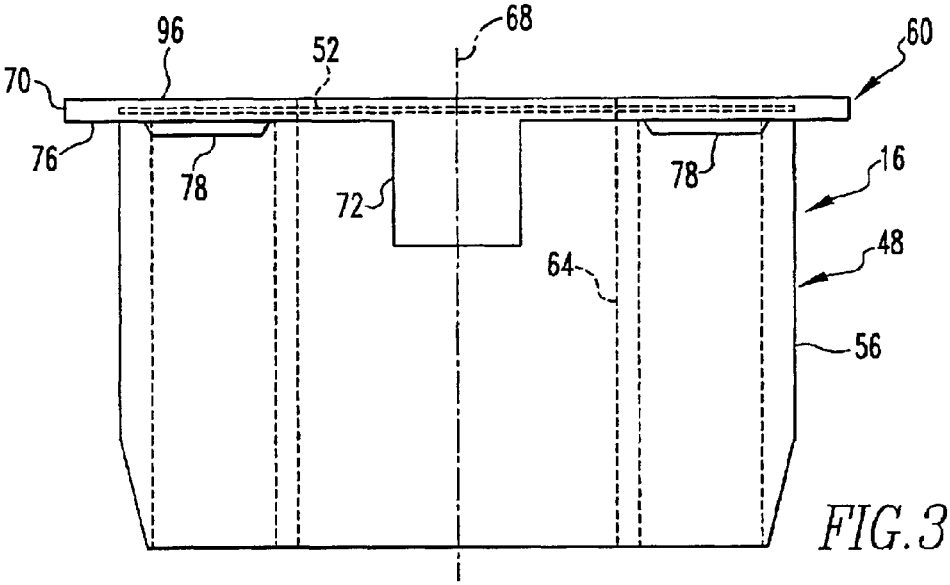
FIG. 3 is an elevational view of the first embodiment.
Figure 4:
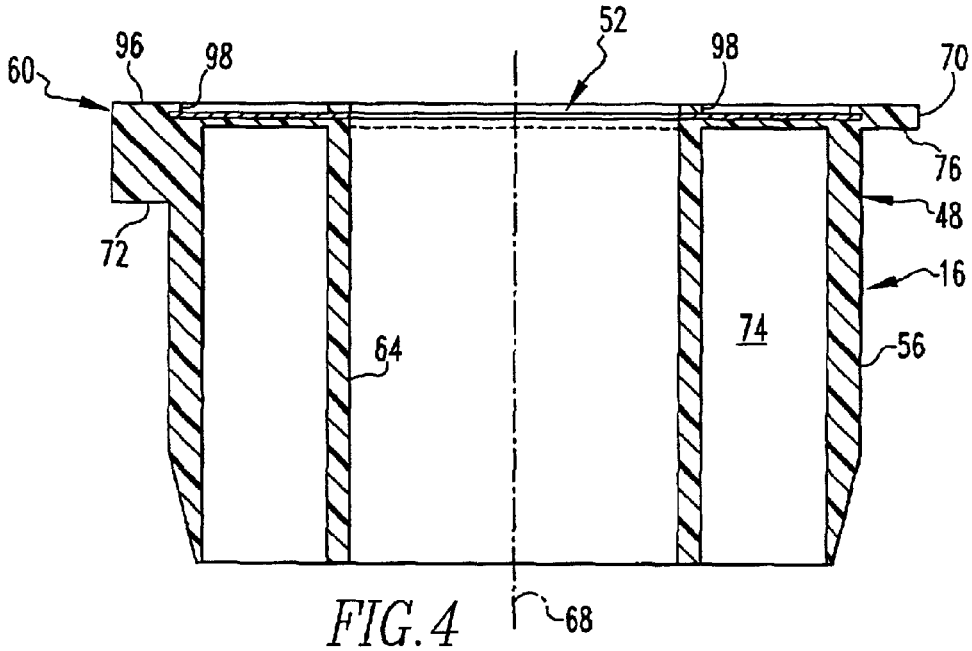
FIG. 4 is a sectional view as taken along line 4—4 of FIG. 2.

The hub 16 is depicted in FIG. 1, and is more particularly depicted in FIGS. 2-4. It can be seen that the hub 16 includes a core 48 and an indication member 52 (FIG. 5), with the indication member 52 being substantially embedded in the core 48. As used herein, the expression "embedded in" and variations thereof shall mean enclosed within or closely surrounded by.

The core 48 may be made of a plastic material that is injection molded, with the indication member 52 being disposed internally within the mold during the molding process. In such a situation, the hub 16 would be manufactured by molding the material of the core 48 about the indication member 52, such that the indication member 52 would be substantially embedded within the core 48.

As is best shown in FIG. 3, the core 48 includes a base 56 and a head 60 connected with one another. As is best shown in FIG. 4, the core 48 is formed with a substantially cylindrical central cavity 64 extending coaxially therethrough. The core 48 also includes a central axis 68 about which the central cavity 64, the base 56, and the head 60 are axially arranged. The indication member 52 is similarly axially disposed with respect to the central axis 68.

As is shown in FIGS. 3 and 4, the head 60 includes a cylindrical portion 70 and a pair of diametrically opposed ears 72. The cylindrical portion 70 is disposed adjacent the base 56 and is of a greater diameter than the base 56 as measured from the perspective of the central axis 68. The ears 72 are shaped to be complementarily received in the notches 44 when the detectable spool 44 is assembled, as will be discussed in greater detail below.

As can further be seen from FIG. 4, the core 48 is formed with a generally annular void 74 extending substantially through the base 56 and terminating generally at the cylindrical portion 70 of the head 60. The void 74 is provided to reduce the weight of the core 48 as well as to reduce the quantity of materials required to manufacture the core 48.

It can be seen that the part of the cylindrical portion 70 which protrudes outwardly beyond the base 56 defines an annular flange 76 that is disposed against one of the ends 40 of the spool 24 when the detectable spool 4 is assembled. It can be seen that the head 60 additionally includes a plurality of arcuate lugs 78 that each extend along a portion of the flange 76. The lugs 78 can be employed in conjunction with a known ultrasonic welding process or other process for fastening the flange 76, and thus the hub 16, to the spool 24.

Figure 5:
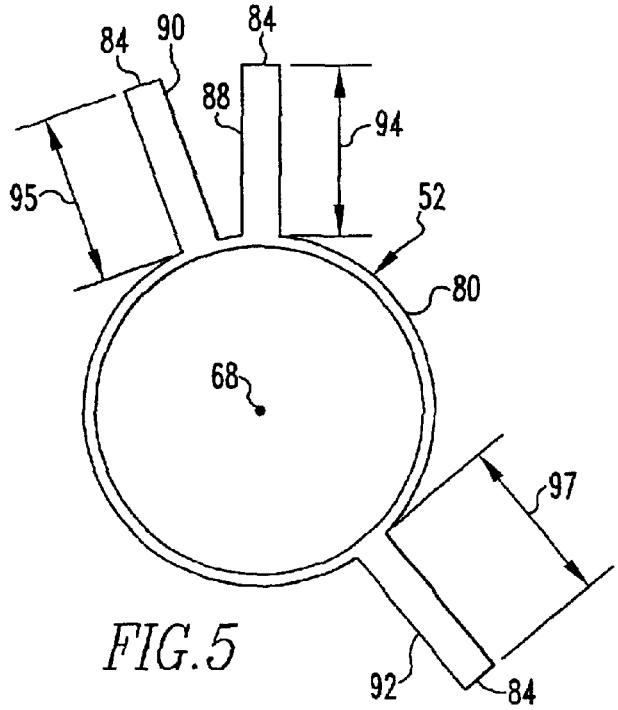
FIG. 5 is a plan view of an indication member of the first embodiment.

As is best shown in FIG. 5, the indication member 52 includes a ring-shaped support 80 and a plurality of tabs 84. The indication member 52 provides indication means and indicia that can be detected by the sensor 12. The support 80 extends between the tabs 84.

The support 80 and the tabs 84 may be formed out of a sheet of metal or may be formed out of a material that is at least partially metallic or ferromagnetic in character. The support 80 and the tabs 84 are all substantially flat and planar in configuration and may be coplanar with one another.

The indication member 52 may be formed as a single-piece monolithically-formed member that is made from a single piece of material such as a sheet of metal. In such a situation, the indication member 52 may be generally planar in configuration, with the support 80 and the tabs 84 being coplanar with one another, although it is understood that other configurations of the indication member 52 are possible.

As can be understood from FIG. 5, the tabs 84 protrude outwardly from the support 80. More specifically, the tabs 84 protrude perpendicularly away from the support 80, meaning that each tab 84 is oriented substantially perpendicular to a tangent to the support 80 in the vicinity of the respective tab 84.

The tabs 84 include a first home tab 88, a second home tab 90, and a characteristic tab 92. It is understood, however, that reference to "tabs 84" will refer collectively to the first and second home tabs 88 and 90 and the characteristic tab 92. The tabs 84 protrude radially outwardly from the support 80 in a direction generally away from the central axis 68 which, in FIG. 5, protrudes perpendicularly out of the plane of the page of FIG. 5 and is thus indicated by a dot therein. It can be seen that each of the tabs 84 include an elongated dimension indicated by the lines 94, 95, and 97 that extends in a generally radial direction with regard to the central axis 68. In one embodiment of the indication member 52, the inner diameter of the support 80 may be about twelve millimeters in diameter, and the elongated dimensions 94, 95, and 97 of the tabs 84 may have a length of about twelve millimeters. It is understood, however, that the indication member 52, as well as the components thereof, may have dimensions and relative physical proportions different than that depicted herein without departing from the concept of the present invention.

The first and second home tabs 88 and 90 are oriented about 20° apart from one another and together define a "home" position on the indication member 52. The characteristic tab 92 is oriented approximately 140° away from the first home tab 88. The position of the characteristic tab 92 with respect to the "home" position defined by the first and second home tab 88 and 90 corresponds with the characteristics of the ribbon 28 wound on the spool 24. The specific position of the characteristic tab 92 depicted generally in FIG. 5 and described above corresponds with a ribbon 28 that is purely black, meaning that the color designation of the ribbon 28 would be "K". As will be set forth more fully below, a different positioning of the characteristic tab 92 with respect to the first and second home tabs 88 and 90 would correspond with and identify a different ribbon having different characteristics than the ribbon 28.

As can be understood from FIG. 4, the indication member 52 is generally embedded within the cylindrical portion 70 of the head 60 of the core 48. The indication member 52 may be embedded about 0.3 millimeters from a generally planar outer surface 96 of the cylindrical portion 70, although other positions for the indication member 52 may be appropriate depending upon the specific configuration thereof.

As can be understood from FIGS. 2 and 4, a plurality of windows 98 are formed in the cylindrical portion 70 between the indication member 52 and the outer surface 96, with the windows 98 being shaped and oriented to correspond with the tabs 84. The windows 98 thus extend between the tabs 84 and the exterior of the hub 16. The windows 98 are generally provided in order to minimize the quantity of material of the core 48 that is interposed between the tabs 84 and the sensor 12 in order to facilitate detection of the tabs 84 by the sensor 12. The windows 98 may be formed in the core 48 in any of a wide variety of fashions including formation of the windows 98 during initial molding of the core 48. It is understood, however, that depending upon the specific configuration of the indication member 52, the material out of which the core 48 is formed, and the depth below the outer surface 96 to which the indication member 52 is embedded, as well as other factors, the hub 16 may be formed without any windows 98 without detection of the tabs 84 by the sensor 12 being meaningfully impaired.

When the hub 16 is mounted on the ribbon spool 20 to form the detectable spool 4, and when the detectable spool 4 is installed into the printer 8, an appropriate mechanism of the printer 8 rotates the detectable spool 4 about the central axis 68 in order for the relative positions of the tabs 84 to be detected by the sensor 12. Once the printer 8 ascertains the position of the characteristic tab 92 with respect to the "home" position defined by the first and second home tabs 88 and 90, the printer 8 then can determine the specific configuration of the ribbon 28 on the detectable spool 4. In this regard, the printer 8 may then commence operations if the characteristics of the ribbon 28 are appropriate to the printing tasks to be undertaken by the printer 8, or an alarm or other indication message may be transmitted to a technician if the ribbon 28 is incorrect.

The core 48 is advantageously manufactured out of a material having a first color that can be readily identified by an observer such as a technician or other operator. The color of the material out of which the core 48 is manufactured is represented by the hatched region of FIG. 2 designated by the numeral 100. The distinctive color of the material of the core 48 thus permits the detectable spool 4 to be identified by the observer and to enable the detectable spool 4 to be distinguished from other detectable spools that may otherwise be similar in appearance to the detectable spool 4. The color of the material out of which the core 48 is formed thus provides indicia and serves as indication means on the detectable spool 4 as to the specific characteristics of the ribbon 28. It is further understood that in other embodiments (not specifically shown) that the core 48 can bear other types of color identification means such as colored adhesive labels, imprintation or coating of the core 48 with pigments or coatings having a color, colored inserts mounted on or partially in the core 48, and myriad other configurations.

The indication member 52 can be relatively inexpensively manufactured, such as by stamping, and can be readily embedded in the core 48. The relative positions of the tabs 84 with respect to one another is advantageously maintained by the support 80 such that the tabs 84 generally cannot be incorrectly positioned on the core 48. This substantially eliminates the need for quality assurance testing as to the relative positions of the tabs 84 as well as the potential for lost production due to manufacturing error in the regard. Moreover, the potential for one or more of the tabs 84 becoming detached from the hub 16 is substantially eliminated since the tabs 84 are connected together with the support 80. Additionally, by configuring the indication member 52 as a monolithically-formed single-piece member, the indication member 52 can be handled as a single unit, as compared with simultaneously handling a plurality of separate metallic members, which facilitates manufacture of the hub 16. Furthermore, the tabs 84 each provide a relatively large member that can be readily detected by the sensor 12, which facilitates rapid operation of the printer 8 after installation of the detectable spool 4.

The configuration of the indication member 52 and thus the hub 16 permits the detectable spool 4 to be manufactured relatively less expensively and more reliably than previously known devices. The indicia provided by the indication member 52 and by the color of the material out of which the core 48 is formed permit the printer 8 and an observer, respectively, to readily ascertain the specific characteristics of the ribbon 28.

Figure 6:
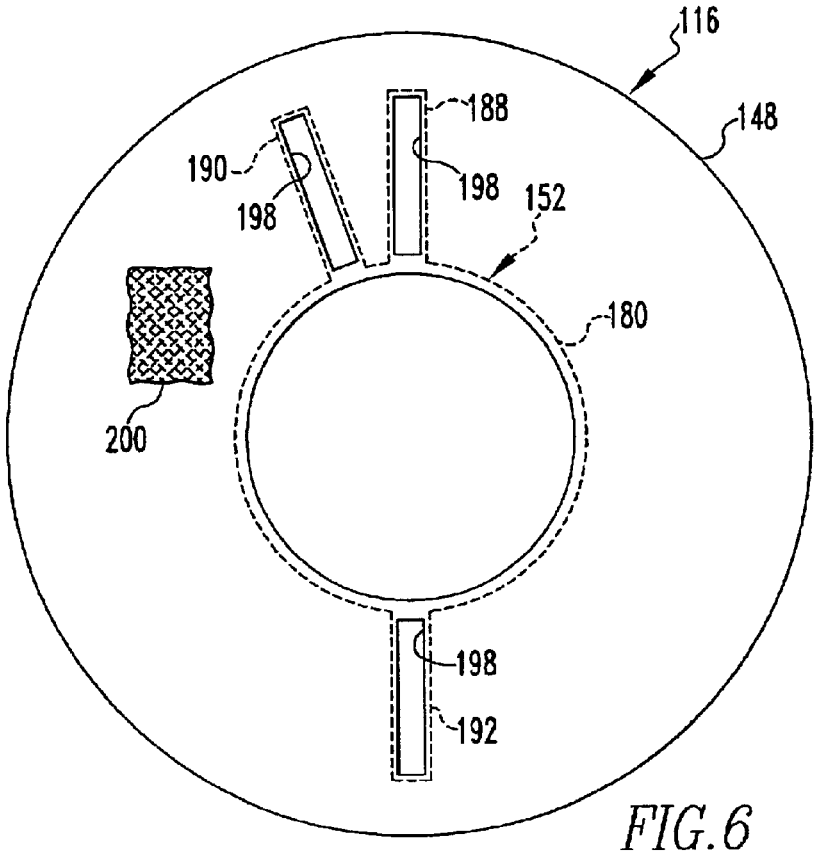
FIG. 6 is a plan view of an improved hub in accordance with a second embodiment of the present invention.

A hub 116 in accordance with a second embodiment of the present invention is indicated generally in FIG. 6. The hub 116 includes a core 148 and an indication member 152, with the indication member 152 being substantially embedded in the core 148. The indication member 152 is generally similar to the indication member 52 except is configured for a ribbon having different characteristics than the ribbon 28.

Figure 7:
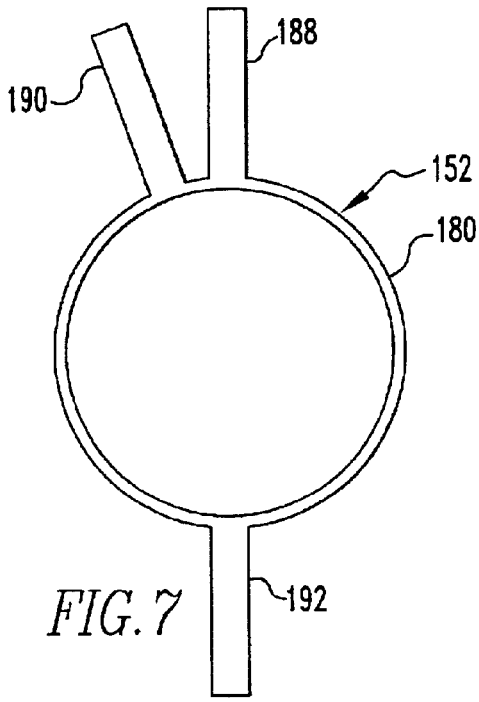
FIG. 7 is a plan view of an indication member of the second embodiment.

It can be seen from FIG. 7 that the indication member 152 includes a generally ring-shaped support 180, along with a first home tab 188, a second home tab 190, and a characteristic tab 192. While the first and second home tabs 188 and 190 are oriented about 20° apart from one another and together define a "home" position for the indication member 152, the characteristic tab 192 is oriented about 160° apart from the second home tab 190. It can be seen that the windows 198 formed in the core 148 correspond with the specific positions of the first and second home tabs 188 and 190 and the characteristic tab 192, and thus are positioned differently than the windows 98 of the core 48. Since the characteristic tab 192 is disposed at a different position with respect to the "home" position than was the characteristic tab 92, the sensor 12 of the printer 8 will detect that the ribbon used in association with the hub 116 is different than the ribbon 28 which is used in association with the hub 16.

The core 148 is formed of a material having a color that is different than the color of the material out of which the core 48 is manufactured. The color of the material out of which the core 148 is manufactured is represented by the hatched region of FIG. 6 designated by the numeral 200. By observing the specific color of the material out of which the core 148 is formed, an observer such as a technician can readily ascertain the characteristics of the ribbon used in association with the hub 116. Moreover, by noting the color of the material out of which the core 148 is made, the observer can readily ascertain that the ribbon used in association with the hub 116 is different than the ribbon 28 used in association with the hub 16. The indication member 152 and the color of the material out of which the core 148 is manufactured thus each serve as indicia and as indication means which permit the printer 8 and an observer, respectively, to readily ascertain the characteristics of the ribbon with which the hub 116 is employed.

Figure 8:
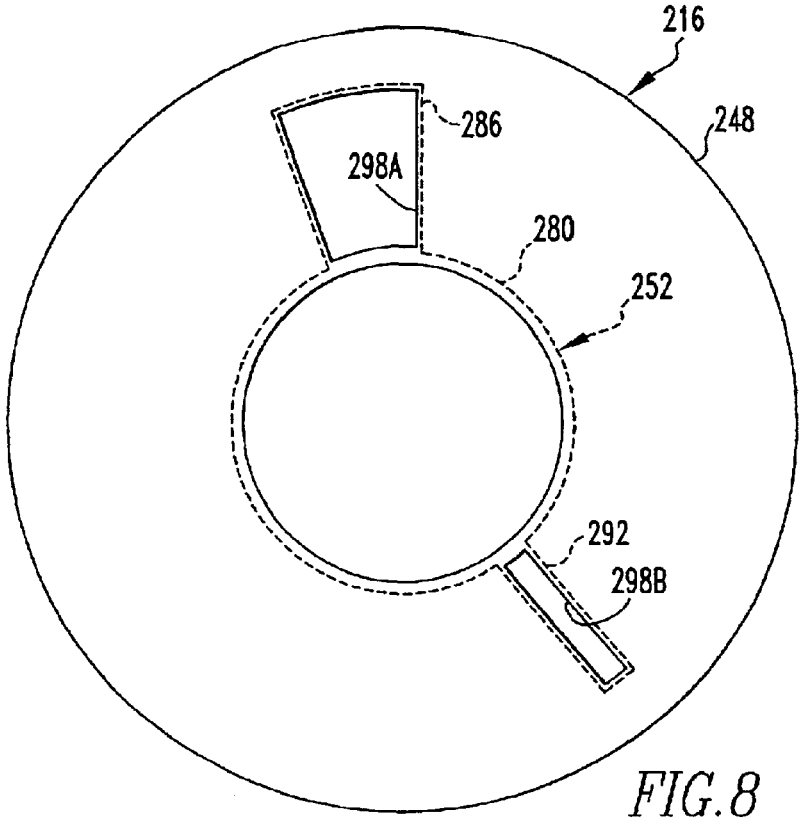
FIG. 8 is a plan view of an improved hub in accordance with a third embodiment of the present invention.
Figure 9:
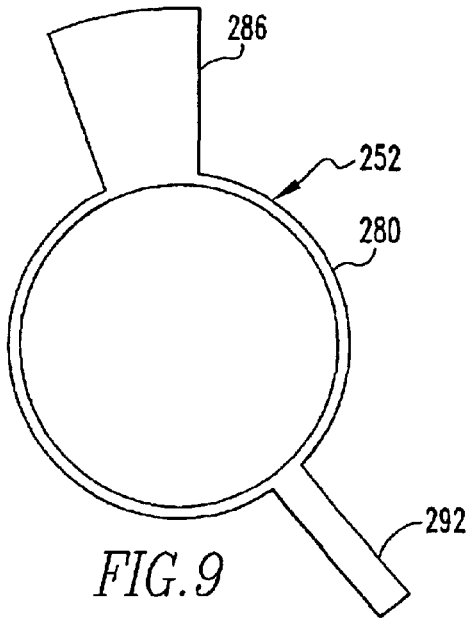
FIG. 9 is a plan view of an indication member of the third embodiment.

A hub 216 in accordance with a third embodiment of the present invention is indicated generally in FIG. 8. The hub 216 includes a core 248 and an indication member 252 (FIG. 9), with the indication member 252 being substantially embedded in the core 248. As can be seen in FIG. 9, the indication member 252 includes a ring-shaped support 280, a composite home tab 286, and a characteristic tab 292. The indication member 252 is similar to the indication member 52, except that the composite home tab 286 takes the place of the first and second home tabs 90 and 92. The composite home tab 286 potentially can be less expensive to manufacture than the separate first and second home tabs 88 and 90, and additionally may be more reliably detected by the sensor 12 of the printer 8.

It can be seen from FIG. 8 that the hub 216 is formed with a relatively large window 298A disposed over the composite home tab 286 and a relatively smaller window 298B disposed over the characteristic tab 292. The windows 298A and 298B permit the sensor 12 to detect the presence and relative orientations of the composite home tab 286 and the characteristic tab 292 in the manner set forth above.

Figure 10:
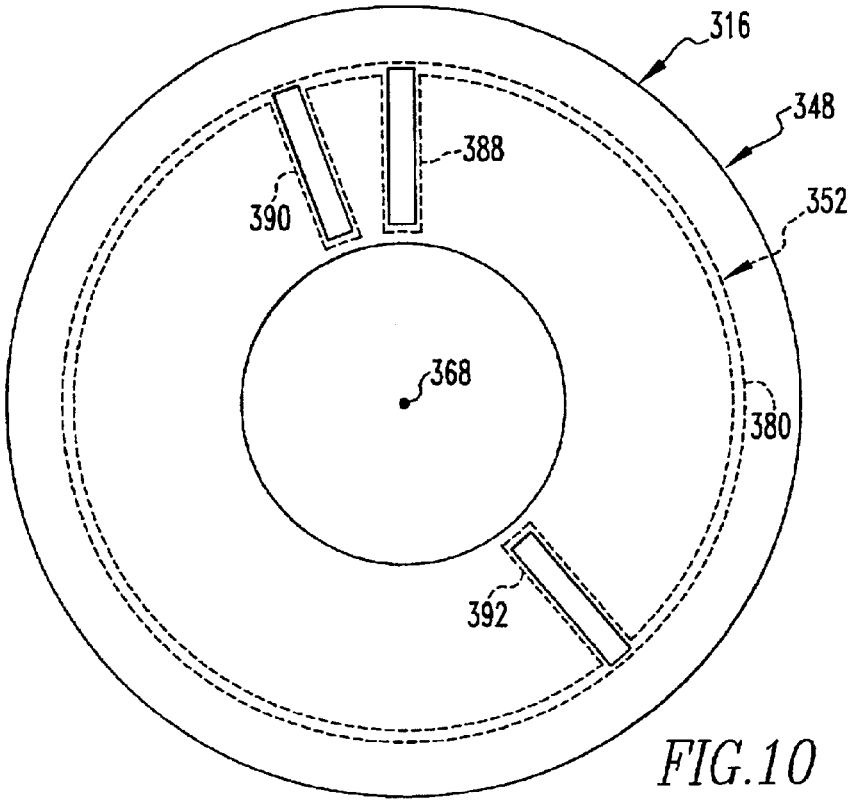
FIG. 10 is a top plan view of an improved hub in accordance with a fourth embodiment of the present invention.

A hub 316 in accordance with a fourth embodiment of the present invention is indicated generally in FIG. 10. The hub 316 includes a core 348 and an indication member 352, with the indication member 352 being substantially embedded in the core 348.

Figure 11:
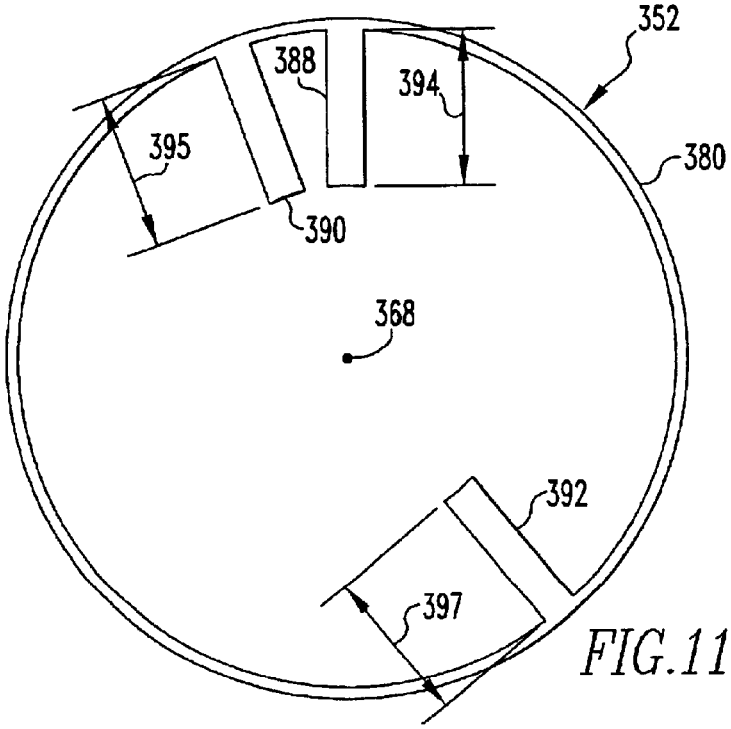
FIG. 11 is a top plan view of an indication member in accordance with the fourth embodiment.

It can be seen from FIG. 11 that the indication member 352 includes a ring-shaped support 380, along with a first home tab 388, a second home tab 390, and a characteristic tab 392. The first and second home tabs 388 and 390 and the characteristic tab 392 are disposed in the same relative positions as the tabs 84 of the hub 16. It can be seen, however, that the support 380 is larger than the support 80, and that the first and second home tabs 388 and 390 and the characteristic tab 392 each include an elongated dimension indicated by the lines 394, 395, 397 that extends in a generally radial direction from the support 380 toward the central axis 368, which is indicated by a dot in FIG. 11. Other than the different configuration of the indication member 352, the hub 316 is substantially similar to the hub 16.

Figure 12:
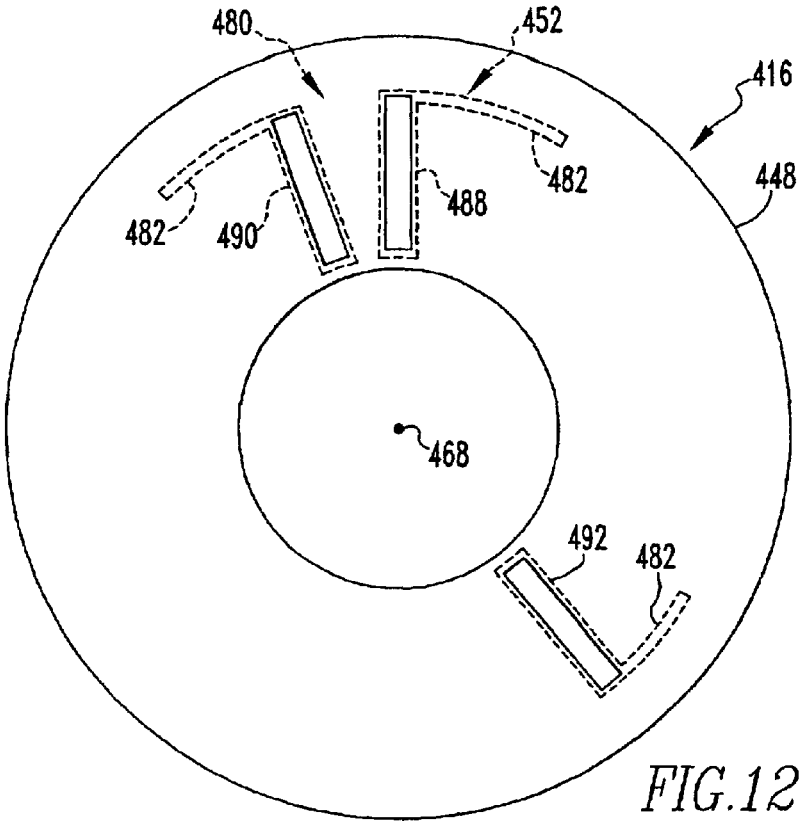
FIG. 12 is a top plan view of an improved hub in accordance with a fifth embodiment of the present invention.
Figure 13:
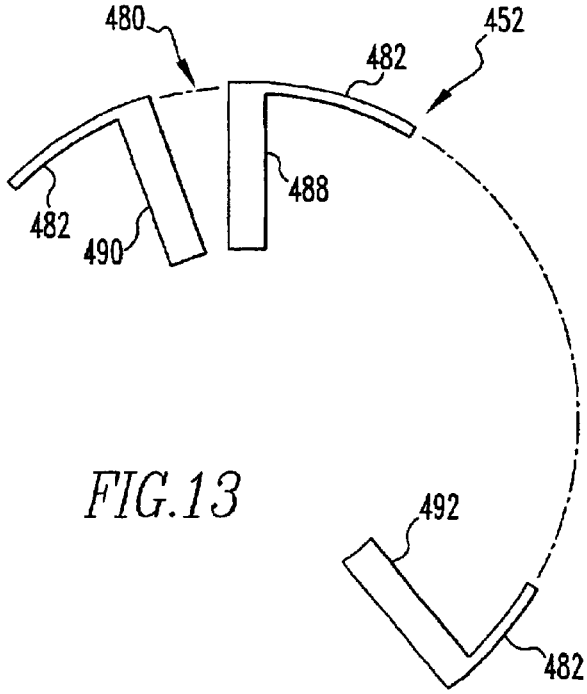
FIG. 13 is a top plan view of an indication member in accordance with the fifth embodiment.

A hub 416 in accordance with a fifth embodiment of the present invention is indicated generally in FIG. 12. The hub 416 includes a core 448 and an indication member 452 (FIG. 13), with the indication member 452 being substantially embedded in the core 448.

The indication member 452 is substantially similar to the indication member 352 in that it includes a support 480, a first home tab 488, a second home tab 490, and a characteristic tab 492, with the first and second home tabs 488 and 490 and the characteristic tab 492 extending from the support 480 toward the central axis 468. The support 480 is, however, made up of a plurality of arcuate support portions 482 that are separated from one another. The first home tab 488 is disposed on one of the support portions 482, the second home tab 490 is disposed on another support portion 482, and the characteristic tab 492 is disposed on yet another support portion 482.

The first and second home tabs 488 and 490 and the characteristic tab 492 are disposed in substantially the same positions as the first and second home tabs 388 and 390 and the characteristic tab 392. By separating the support 480 into the plurality of support portions 482, the support 480 causes relatively less interference when the sensor 12 is seeking to detect the presence of the first and second home tabs 488 and 490 and the characteristic tab 492. As such, the specific configuration of the indication member 452 can be detected by the sensor 12 relatively more readily than the indication member 352 can be detected. The hub 416 is otherwise substantially similar to the hub 16.

As can be seen from the foregoing, any of the hubs 16, 116, 216, 316, and 416 can be employed in the detectable spool 4 for use in the printer 8. The relatively different configurations of the indication members 52 and 152, along with the difference in coloration of the material out of which the cores 48 and 148 are manufactured, each provide indicia that serve as indication means that indicate to the printer 8 and to an observer, respectively, the specific, characteristics of the ribbon 28 mounted on the spool 24. The additionally different configurations of the indication members 252, 352, and 452, and the correspondingly different configurations of the cores 248, 348, and 448, have different characteristics which can be detected by the sensor 12 and that may be desirable depending upon the specific application.

It is understood that the material out of which the cores 248, 348, and 448 are manufactured would be of the same color as the material out of which the core 48 is manufactured since all four of the indication members 52, 252, 352, and 452 have a substantially similar tab configuration. In this regard, it is understood that any of the indication members 252, 352, and 452 can be configured to have a tab configuration similar to the indication member 152. In such a circumstance, the material out of which the cores 248, 348, and 448 are made would be of the same color as the material out of which the core 148 is manufactured. It is further understood that any of the indication members 52, 152, 252, 352, and 452 can have a different tab configuration than those set forth herein, and it will be similarly understood that the corresponding cores 48, 148, 248, 348, and 448 will be manufactured out of a material that is correspondingly differently colored to provide visual indicia to an observer of the characteristics of the corresponding ribbon 28.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A method of employing a hub of a type being structured for use in conjunction with a spool having a quantity of material wrapped thereon, the material having a number of known characteristics, for determining at least a first known characteristic of the number of known characteristics of the material, the method comprising:

employing a core including a central axis, the core being structured to be disposed on the spool;

employing an indication member, the indication member including a support, at least a first tab, and a second tab;

employing the at least first tab as an at least first home tab defining a home position of the indication member;

employing the second tab as a characteristic tab, the support being mounted on the core, the at least first and second tabs being disposed on the support, the at least first and second tabs each including an elongated dimension that extends in a generally radial direction with respect to the central axis of the core, the second tab being oriented at one of a plurality of known angles with respect to the at least first home tab;

detecting the orientation of the second tab with respect to the at least first home tab; and employing the detected orientation of the second tab with respect to the at least first home tab to determine said at least a first known characteristic of the number of known characteristics of the material.

2. A hub for use in conjunction with a spool having a quantity of material wrapped thereon, the material having a number of known characteristics, the hub comprising:

a core including a central axis;

the core being structured to be disposed on the spool;

an indication member;

the indication member including a support, at least a first tab, and a second tab;

the at least first tab being an at least first home tab and defining a home position of the indication member;

the second tab being a characteristic tab;

the support being mounted on the core;

the at least first and second tabs being disposed on the support;

the at least first and second tabs each including an elongated dimension that extends in a generally radial direction with respect to the central axis of the core;

the second tab being oriented at one of a plurality of known angles with respect to the at least first home tab; and the orientation of the second tab with respect to the at least first home tab corresponding with the characteristics of the material; and wherein the support is substantially embedded in the core.

3. The hub of claim 2, wherein the indication member is generally flat; and the support and the at least first tab being generally coplanar.

4. The hub of claim 2, wherein the indication member is a monolithically-formed single-piece member.

5. The hub of claim 4, wherein the support extends between the at least first and second tabs;

the support being at least partially arcuate.

6. The hub of claim 2, wherein the support is an elongated arcuate member; and the at least first tab extending generally perpendicularly away from the support.

7. The hub of claim 2, wherein the at least first tab extends from the support in a direction generally away from the central axis.

8. The hub of claim 2, wherein the at least first tab extends from the support in a direction generally toward the central axis.

9. The hub of claim 2, wherein the support is generally ring-shaped.

10. The hub of claim 2, wherein the indication member is at least partially metallic.

11. A hub for use in conjunction with a spool having a quantity of material wrapped thereon, the material having a number of known characteristics, the hub comprising:

a core including a central axis;

the core being structured to be disposed on the spool;

an indication member;

the indication member including a support, at least a first tab, and a second tab;

the at least first tab being an at least first home tab and defining a home position of the indication member;

the second tab being a characteristic tab;

the support being mounted on the core;

the at least first and second tabs being disposed on the support;

the at least first and second tabs each including an elongated dimension that extends in a generally radial direction with respect to the central axis of the core;

the second tab being oriented at one of a plurality of known angles with respect to the at least first home tab; and the orientation of the second tab with respect to the at least first home tab corresponding with the characteristics of the material;

wherein the support includes a first support portion and a second support portion that are separated from one another;

the at least first tab being disposed on and extending from the first support portion; and the second tab being disposed on and extending from the second support portion.

12. A hub for use in conjunction with a spool, the hub comprising:

a core including a central axis;

the core being structured to be disposed on the spool;

an indication member;

the indication member including a support and at least a first tab;

the support being mounted on the core;

the at least first tab being disposed on the support; and the at least first tab including an elongated dimension that extends in a generally radial direction with respect to the central axis of the core the support being substantially embedded in the core;

wherein the at least first tab is substantially embedded in the core;

a window is formed in the core; and the window extending between the at least first tab and the exterior of the core.

13. A method of employing a hub of a type being structured for use in conjunction with a spool having a quantity of material wrapped thereon, the material having a number of known characteristics, for determining at least a first known characteristic of the number of known characteristics of the material, the method comprising:

employing a core having a central axis and being structured to be disposed on the spool; and employing an indication member, the indication member including a support, at least a first tab, and a second tab;

employing the at least first tab as an at least first home tab defining a home position of the indication member;

employing the second tab as a characteristic tab, the support being mounted on the core, the at least first and second tabs being disposed on the support, the at least first and second tabs each including an elongated dimension that extends in a generally radial direction with respect to the central axis or the core, the second tab being oriented at one of a plurality of known angles with respect to the at least first home tab; and detecting the orientation of the second tab with respect to the at least first home tab; and employing the detected orientation of the second tab with resect to the at least first home tab to determine said at least a first known characteristic of the number of known characteristics of the material, the support, the at least first tab, and the second tab each being of a generally planar configuration.

14. A hub for use in conjunction with a spool having a quantity of material wrapped thereon, the material having a number of known characteristics, the hub comprising:

a core having a central axis being structured to be disposed on the spool; and an indication member;

the indication member including a support, at least a first tab, and a second tab;

the at least first tab being an at least first home tab and defining a home position of the indication member;

the second tab being a characteristic tab;

the support being mounted on the core;

the at least first and second tabs being disposed on the support;

the at least first and second tabs each including an elongated dimension that extends in a generally radial direction with respect to the central axis of the core;

the second tab being oriented at one of a plurality of known angles with respect to the at least first home tab; and the orientation of the second tab with respect to the at least first home tab corresponding with the characteristics of the material; and the support, the at least first tab, and the second tab each being of a generally planar configuration; and wherein the support is substantially embedded in the core.

15. The hub of claim 14, wherein the support, the at least first tab, and the second tab are generally coplanar.

16. The hub of claim 14, wherein the core is structured to be rotated about the central axis, the rotational distance between the home position and the second tab corresponding with the characteristics of the material.

17. The hub of claim 16, wherein the indication member is a monolithically-formed single-piece member.

18. The hub of claim 17, wherein the support extends between the at least first and second tabs;

the support being at least partially arcuate.

19. The hub of claim 16, wherein the at least first tab extends from the support in a direction generally away from the central axis.

20. The hub of claim 16, wherein the at least first tab extends from the support in a direction generally toward the central axis.

21. The hub of claim 14, wherein the support is an elongated arcuate member; and wherein the at least first tab extends generally perpendicularly away from the support.

22. The hub of claim 14, wherein the support is generally ring-shaped.

23. The hub of claim 14, wherein the indication member is at least partially metallic.

24. A hub for use in conjunction with a spool having a quantity of material wrapped thereon, the material having a number of known characteristics, the hub comprising:

a core having a central axis and being structured to be disposed on the spool; and an indication member;

the indication member including a support at least a first tab, and a second tab;

the at least first tab being an at least first home tab and defining a home position of the indication member;

the second tab being a characteristic tab:

the support being mounted on the core;

the at least first and second tabs being disposed on the support;

the at least first and second tabs each including an elongated dimension that extends in a generally radial direction with respect to the central axis of the core;

the second tab being oriented at one of a plurality of known angles with respect to the at least first home tab; and the orientation of the second tab with respect to the at least first home tab corresponding with the characteristics of the material; and the support, the at least first tab, and the second tab each being of a generally planar configuration;

wherein the support includes a first support portion and a second support portion that are separated from one another;

the at least first tab being disposed on and extending from the first support portion; and the second tab being disposed on and extending from the second support portion.

25. A hub for use in conjunction with a spool, the hub comprising:

a core structured to be disposed on the spool; and an indication member;

the indication member including a support and at least a first tab;

the support being mounted on the core;

the at least first tab being disposed on the support;

the support and the at least first tab each being of a generally planar configuration;

wherein the at least first tab is substantially embedded in the core;

a window being formed in the core; and the window extending between the at least first tab and the exterior of the core.

26. A method for employing a detectable spool in a printer, the method comprising:

employing a spool including a central axis and being structured to have a quantity of material wrapped thereon, the material having a number of known characteristics;

employing indication means disposed on the spool, the indication means including an indication member, the indication member including a support, at least a first tab, and a second tab; and the at least first and second tabs each including an elongated dimension that extends in a generally radial direction with respect to the central axis;

employing the at least first tab as an at least first home tab defining a home position of the indication member;

employing the second tab as a characteristic tab, the second tab being oriented at one of a plurality of known angles with respect to the at least first home tab; and detecting the orientation of the second tab with respect to the at least first home tab; and employing the detected orientation of the second tab with respect to the at least first home tab to determine at least a first known characteristic of the number of known characteristics of the material.

27. A detectable spool for use in a printer, the detectable spool comprising:

a spool including a central axis and being structured to have a quality of material wrapped thereon, the material having a number of known characteristics;

indication means disposed on the spool;

the indication means including an indication member;

the indication member including a support, at least a first tab, and a second tab; and the at least first and second tabs each including an elongated dimension that extends in a generally radial direction with respect to the central axis;

the at least first tab being an at least first home tab and defining a home position of the indication member;

the second tab being a characteristic tab;

the second tab being oriented at one of a plurality of known angles with respect to the at least first home tab; and the orientation of the second tab with respect to the at least first home tab corresponding with the characteristics of the material;

wherein the indication means further includes a core;

the support being substantially embedded in the core; and the core being disposed on the spool.

28. The detectable spool of claim 27, wherein the indication member is generally flat; and the support and the at least first tab being generally coplanar.

29. The detectable spool of claim 27, wherein the indication member is a monolithically-formed single-piece member.

30. The detectable spool of claim 29, wherein the support extends between the at least first and second tabs;

the support being at least partially arcuate.

31. The detectable spool of claim 27, wherein the support is an elongated arcuate member; and the at least first tab extending generally perpendicularly away from the support.

32. The detectable spool of claim 27, wherein the at least first tab extends from the support in a direction generally away from the central axis.

33. The detectable spool of claim 27, wherein the at least first tab extends from the support in a direction generally toward the central axis.

34. The detectable spool of claim 27, wherein the support is generally ring-shaped.

35. The detectable spool of claim 27, wherein the indication member is at least partially metallic.

36. A detectable spool for use in a printer, the detectable spool comprising:

a spool including a central axis and being structured to have a quantity of material wrapped thereon, the material having a number of blown characteristics;

indication means disposed on the spool;

the indication means including an indication member;

the indication member including a support, at least a first tab, and a second tab; and the at least first and second tabs each including an elongated dimension that extends in a generally radial direction with respect to the central axis;

the at least first tab being an at least first home tab an defining a home position of the indication member;

the second tab being a characteristic tab;

the second tab being oriented at one of a plurality of known angles with respect to the at least first home tab; and the orientation of the second tab with respect to the at least first home tab corresponding with the characteristics of the material;

wherein the support includes a first support portion and a second support portion that are separated from one another;

the at least first tab being disposed on and extending from the first support portion; and the second tab being disposed on and extending from the second support portion.

37. A detectable spool for use in a printer, the detectable spool comprising:

a spool including a central axis;

indication means disposed on the spool;

the indication means including an indication member;

the indication member including a support and at least a first tab;

the at least first tab including an elongated dimension that extends in a generally radial direction with respect to the central axis the indication means further including a core;

the support being substantially embedded in the core;

the core being disposed on the spool;

wherein the at least first tab is substantially embedded in the core;

a window being formed in the core; and the window extending between the at least first tab and the exterior of the core.

38. A method for employing a detectable spool in a printer, the method comprising:

employing a spool having a central axis and being structured to have a quantity of material wrapped thereon, the material having a number of known characteristics; and employing indication means disposed on the spool, the indication means including an indication member, the indication member including a support, at least a first tab, and a second tab;

employing the at least first tab as an at least first home tab defining a home position of the indication member;

employing the second tab as a characteristic tab, the at least first and second tabs each including an elongated dimension that extends, in a generally radial direction with respect to the central axis of the core, the second tab being oriented at one of a plurality of known angles with respect to the at least first home tab; and detecting the orientation of the second tab with respect to the at least first home tab; and employing the detected orientation of the second tab with respect to the at least first home tab to determine at least a first known characteristic of the number of known characteristics of the material, the support, the at least first tab, and the second tab each being of a generally planar configuration.

39. A detectable spool for use in a printer, the detectable spool comprising:

a spool having a central axis and being structured to have a quantity of material wrapped thereon, the material having a number of known characteristics; and indication means disposed on the spool;

the indication naps including an indication member:

the indication member including a support, at least a first tab, and a second tab;

the at least first tab being an at least first home tab and defining a home position of the indication member;

the second tab being a characteristic tab;

the at least first and second tabs each including an elongated dimension that extends in a generally radial direction with respect to the central axis of the core;

the second tab being oriented at one of a plurality of known angles with respect to the at least first home tab; and the orientation of the second tab with respect to the at least first home tab corresponding with the characteristics of the material; and the support, the at least first tab, and the second tab each being of a generally planar configuration;

wherein the indication means further includes a core;

the support being substantially embedded in the core; and the core being disposed on the spool.

40. The detectable spool of claim 39, wherein the support, the at least first tab, and the second tab are generally coplanar.

41. The detectable spool of claim 39, wherein the indication member is a thin sheet of an at least partially metallic material.

42. The detectable spool of claim 41, wherein the indication member is a monolithically-formed single-piece member.

43. The detectable spool of claim 42, wherein the support extends between the at least first and second tabs;

the support being at least partially arcuate.

44. The detectable spool of claim 39, wherein the at least first tab extends from the support in a direction generally away from the central axis.

45. The detectable spool of claim 39, wherein the at least first tab extends from the support in a direction generally toward the central axis.

46. The detectable spool of claim 39, wherein the support is an elongated arcuate member; and the at least first tab extending generally perpendicularly away from the support.

47. The detectable spool of claim 39, wherein the support is generally ring-shaped.

48. The detectable spool of claim 39, wherein the indication member is at least partially metallic.

49. A detectable spool for use in a printer, the detectable spool comprising:

a spool having a central axis and being structured to have a quantity of material wrapped thereon, the material having a number of known characteristics; and indication means disposed on the spool;

the indication means including an indication member;

the indication member including a support, at least a first tab, and a second tab;

the at least first tab being an at least first home tab and defining a home position of the indication member;

the second tab being a characteristic tab;

the at least first and second tabs each including an elongated dimension that extends in a generally radial direction with respect to the central axis of the core;

the second tab being oriented at one of a plurality of known angles with respect to the at least first home tab; and the orientation of the second tab with respect to the at least first home tab corresponding with the characteristics of the material; and the support, the at least first tab, and the second tab each being of a generally planar configuration;

wherein the support includes a first support portion and a second support portion that are separated from one another;

the at least first tab being disposed on and extending from the first support portion; and the second tab being disposed on and extending from the second support portion.

50. A detectable spool for use in a printer, the detectable spool comprising:

a spool; and indication means disposed on the spool;

the indication means including an indication member;

the indication member including a support and at least a first tab;

the support and the at least first tab each being of a generally planar configuration;

the indication means further including a core;

the support being substantially embedded in the core;

the core being disposed on the spool;

wherein the at least first tab is substantially embedded in the core;

a window being formed in the core; and the window extending between the at least first tab and the exterior of the core.

51. A method of employing a hub of a type being structured for use in conjunction with a spool having a quantity of material wrapped thereon, the material having a number of known characteristics, for determining at least a first known characteristic of the number of known characteristics of the material, the method comprising:

employing a core including a central axis, the core being structured to be disposed on the spool; and employing an indication member, the indication member including a support and a plurality of tabs;

employing a first tab of the plurality of tabs as an at least first home tab and defining a home position of the indication member;

employing a second tab of the plurality of tabs as a characteristic tab, the support being mounted on the core, the tabs being disposed on the support the at least first and second tabs each including an elongated dimension that extends in a generally radial direction with respect to the central axis of the core, the second tab being oriented at one of a plurality of known angles with respect to the at least first home tab; and detecting the orientation of the second tab with respect to the at least first home tab; and employing the detected orientation of the second tab with respect to the at least first home tab to determine said at least a first known characteristic of the number of known characteristics of the material, the support extending between the tabs.

52. A hub for use in conjunction with a spool having a quantity of material wrapped thereon, the material having a number of known characteristics, the hub comprising:

a core including a central axis;

the core being structured to be disposed on the spool; and an indication member;

the indication member including a support and a plurality of tabs;

a first tab of the plurality of tabs being an at least first home tab and defining a home position of the indication member;

a second tab of the plurality of tabs being a characteristic tab;

the support being mounted on the core;

the tabs being disposed on the support;

the at least first and second tabs each including an elongated dimension that extends in a generally radial direction with respect to the central axis of the core;

the second tab being oriented at one of a plurality of known angles with respect to the at least first home tab; and the orientation of the second tab with respect to the at least first home tab corresponding with the characteristics of the material;

the support extending between the tabs; and wherein the support is substantially embedded in the core.

53. The hub of claim 52, wherein the indication member is generally flat; and the support and the tabs being generally coplanar.

54. The hub of claim 52, wherein the indication member is a monolithically-formed single-piece member.

55. The hub of claim 52, wherein the support is at least partially arcuate.

56. The hub of claim 55, wherein the tabs each extend generally perpendicularly away from the support.

57. The hub of claim 55, wherein the support is generally ring-shaped.

58. The hub of claim 52, wherein the support includes a central axis; and the tabs extend from the support in a direction generally away from the central axis.

59. The hub of claim 52, wherein the support includes a central axis; and wherein the tabs extend from the support in a direction generally toward the central axis.

60. The hub of claim 52, wherein the core is colored, the color of the core corresponding with the orientation of the second tab with respect to the at least first home tab.

61. The hub of claim 60, wherein the core is formed of a material having a color corresponding with the orientation of the second tab with respect to the at least first home tab.

62. The hub of claim 52, wherein the indication member is at least partially metallic.

63. A hub for use in conjunction with a spool having a quantity of material wrapped thereon, the material having a number of known characteristics the hub comprising:

a core including a central axis;

the core being structured to be disposed on the spool; and an indication member;

the indication member including a support and a plurality of tabs;

a first tab of the plurality of tabs being an at least first home tab and defining a home position of the indication member;

a second tab of the plurality of tabs being a characteristic tab;

the support being mounted on the core;

the tabs being disposed on the support;

the at least first and second tabs each including an elongated dimension that extends in a generally radial direction with respect to the central axis of the core;

the second tab being oriented at one of a plurality of known angles with respect to the at least first home tab; and the orientation of the second tab with respect to the at least first home tab corresponding with the characteristics of the material; and the support extending between the tabs;

wherein the support includes a first support portion and a second support portion that are separated from one another;

one of the tabs being disposed on and extending from the first support portion; and another of the tabs being disposed on and extending from the second support portion.

64. A hub for use in conjunction with a spool, the hub comprising:

a core including a central axis;

the core being structured to be disposed on the spool; and an indication member;

the indication member including a support and a plurality of tabs;

the support being mounted on the core;

the tabs being disposed on the support; and the support extending between the tabs;

the support being substantially embedded in the core;

wherein the tabs are substantially embedded in the core;

a plurality of windows being formed in the core; and the windows each extending between one of the tabs and the exterior of the core.

65. A method of employing an indication member of a type being structured for incorporation into a detectable spool for use in a printer, the spool having a quantity of material wrapped thereon, the material having a number of known characteristics, the printer including a sensing apparatus, the method comprising:

employing a support;

employing a plurality of tabs;

employing a first tab of the plurality of tabs as an at least first home tab defining a home position of the indication member;

employing a second tab of the plurality of tabs as a characteristic tab, the support extending between the at least first and second tabs, the at least first and second tabs each including an elongated dimension that extends in a generally radial direction with respect to the support, the second tab being oriented at one of a plurality of known angles with respect to the at least first home tab;

detecting the orientation of the second tab with respect to the at least first home tab; and employing the detected orientation of the second tab with respect to the at least first home tab to determine at least a first known characteristic of the number of known characteristics of the material, the at least first and second tabs protruding from the support, the tabs being structured to be detectable by the sensing apparatus.

66. The method of claim 65, wherein the indication member is generally flat; and the support and the tabs being generally coplanar.

67. The method of claim 65, wherein the indication member is a monolithically-formed single-piece member.

68. The method of claim 65, wherein the support is at least partially arcuate.

69. The method of claim 68, wherein the support is generally ring-shaped.

70. The method of claim 68, wherein the tabs each extend generally perpendicularly away from the support.

71. The method of claim 70, wherein the support includes a central axis; and the tabs extend from the support in a direction generally away from the central axis.

72. The method of claim 70, wherein the support includes a central axis; and the tabs extend from the support in a direction generally toward the central axis.

73. The method of claim 65, wherein the member is at least partially metallic.

* * * * *

UNITED STATES PATENT AND TRADEMARK OFFICE

CERTIFICATE OF CORRECTION

PATENT NO. : 6,786,660 B1
DATED : September 7, 2004
INVENTOR(S) : Ernie L. Woosley et al.

It is certified that error appears in the above-identified patent and that said Letters Patent is hereby corrected as shown below:

Column 16,
Line 15, “naps” should read -- means --.

Column 18,
Line 1, insert a -- , -- after “support”.

Column 19,
Line 10, insert a -- , -- after “characteristics”.

Column 20,
Line 52, insert -- indication -- prior to “member”.

Signed and Sealed this

Nineteenth Day of April, 2005

JON W. DUDAS
*Director of the United States Patent and Trademark Office*